US007942488B2

(12) United States Patent
Lang

(10) Patent No.: US 7,942,488 B2
(45) Date of Patent: May 17, 2011

(54) CUSTOM COLOR PRINTHEAD MODULE

(75) Inventor: Joseph Herman Lang, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 225 days.

(21) Appl. No.: 12/040,344

(22) Filed: Feb. 29, 2008

(65) Prior Publication Data

US 2009/0219312 A1 Sep. 3, 2009

(51) Int. Cl.
*B41J 2/195* (2006.01)

(52) U.S. Cl. ..... 347/7; 347/43; 347/85; 347/88; 347/95; 347/100

(58) Field of Classification Search ..... 347/88, 347/7

See application file for complete search history.

(56) References Cited

U.S. PATENT DOCUMENTS 4,539,568 A * 9/1985 Lewis et al. ..... 347/88
5,123,961 A * 6/1992 Yamamoto ..... 106/31.29
6,052,195 A * 4/2000 Mestha et al. ..... 356/425
6,394,575 B1 * 5/2002 Kent ..... 347/21
6,698,869 B2 * 3/2004 Vosahlo ..... 347/85
6,938,984 B2 * 9/2005 German et al. ..... 347/43
6,947,175 B1 9/2005 Caruthers
6,993,272 B2 1/2006 Lange et al.
7,024,149 B2 * 4/2006 Kito et al. ..... 399/341
7,305,200 B2 12/2007 Hoffman et al.

* cited by examiner

*Primary Examiner* — Matthew Luu
*Assistant Examiner* — Brian J Goldberg
(74) *Attorney, Agent, or Firm* — Maginot, Moore & Beck LLP

(57) ABSTRACT

A custom color printhead module comprises a mixing reservoir having a first opening and a second opening each configured to receive a first colored ink and a second colored ink and to mix the ink in the reservoir to form a custom colored ink. A first and a second reservoir supply valve are connected to the first and second opening, respectively, to open and close the first and second openings to enable and disable a flow of a first colored ink and a second colored ink into the mixing reservoir. A printhead is connected to the mixing reservoir to receive the custom colored ink from the mixing reservoir. A housing is configured to support the mixing reservoir and the printhead and configured for connection and removal from an imaging device.

7 Claims, 2 Drawing Sheets

CUSTOM COLOR PRINTHEAD MODULE

TECHNICAL FIELD

This disclosure relates generally to ink jet printers, and, in particular, to ink jet printers that use custom colored inks.

BACKGROUND

In general, ink jet printing machines or printers include at least one printhead unit that ejects drops or jets of liquid ink onto an image receiving surface such as an image substrate. A phase change ink jet printer employs phase change inks that are in the solid phase at ambient temperature, but transition to a liquid phase at an elevated temperature. The melted ink can then be ejected as drops or jets by a printhead assembly onto an image substrate at the elevated operating temperature of the machine or printer. The image receiving surface may be a recording media in which case the ink can be ejected directly onto the image substrate, or, alternatively, an intermediate transfer surface in which case the ink is ejected onto the intermediate transfer surface and subsequently transferred to a recording media.

A color printer typically uses four colors of ink (yellow, cyan, magenta, and black). In a phase change ink, or solid ink printer, ink sticks of each of these colors are typically inserted into an ink loading station and subsequently delivered to a melting station which heats the solid ink sticks to a melting temperature and supplies the melted ink to the printhead assembly. In order to print multicolor images, ink jet printers, including solid ink printers, have used a halftone imaging process. As is known in the art, in halftone imaging, an input image may be divided into a series of color separated images, each one of which corresponds to a primary color in the input image. Each color separated image is printed with a complementary ink marking material in a primary color or a colorant which is the subtractive complement of the color separated image. Superimposing the printed color separated images, in registration, on one another produces a pattern of different primary colors or their subtractive compliments that the human eye perceives as a composite color image rather than the color separated images.

The range of colors that can be produced by halftone processes is determined by the number of primary colors that are used and the colors of those primaries. Generally a four-color process is employed using cyan, magenta, yellow and black primary colors. In order to expand the range of colors that may be produced by halftone processes, the printer may be augmented with additional ink colors beyond the usual four primary colors. For example, in a solid ink printer, solid ink sticks having colors other than cyan, magenta, yellow and black may be used such as orange, green, etc. These additional inks may be used to extend the color gamut of the halftone process color output.

Customer selectable colors are typically utilized to provide instant identification and authenticity to a document. As such, the customer is usually highly concerned that the color meets particular color specifications. A more specialized example of customer selectable color output can be found in the field of "custom color", which specifically refers to registered proprietary colors, such as those used, for example, in corporate logos, authorized letterhead and official seals. Because of the importance of customer-selected color to high-end printing, most printers that support color printing allow specification of colors by indicating a name or number defined in a specification system such as the Pantone Matching System or Pantone Goe System, or by coordinates in some color description coordination and/or space, such as CIELAB's L*a*b* coordinates.

There are many colors available using the Pantone system or other color formula guides of this nature, however, that may not be adequately produced via typical half tone process color methods. For example, custom colors may be difficult to accurately generate via halftone methods because the production of solid image areas of a particular color using halftone techniques typically yields non-uniformity of the color in the image area, which can be objectionable in some applications. Moreover, lines and text produced by halftone methods are very sensitive to misregistration of the multiple color images such that blurring, color variances, and other image quality defects may result.

In previously known solid ink printing systems, custom color printing has been carried out by providing solid ink sticks comprised of a premixed phase change ink composition made up of a mixture of multiple color inks blended in preselected concentrations for producing the desired custom color output. Custom color ink sticks are typically prepared at an off-site facility for subsequent delivery to the customer. For example, a customer can order a desired color of ink stick from an ink supplier. This process is commonly facilitated by reference to a name or number defined in a color specification system, e.g., Pantone number. Pantone colors typically have a "recipe" associated with them that defines, for example, a ratio of basic color components that are used to produce the desired color. The ink supplier mixes the component inks according to the Pantone recipe to produce the desired color and delivers the premixed custom color ink sticks to the customer. Because customer selectable colors are typically manufactured at an off-site location, however, supplies of each customer selectable color ink stick may have to be ordered well in advance of their actual use. In addition, customers may be required to order large quantities of the custom color ink sticks from the ink supplier, which may be more than they require or cost more money than they desire to spend.

SUMMARY

A custom color printhead module has been developed that is capable of mixing custom color inks for an imaging device from a preloaded set of color ink sticks. The custom color printhead module comprises a mixing reservoir having a first opening and a second opening. The first opening is configured for removable connection to a first ink source for supplying a first colored ink having a first color. The second opening is configured for removable connection to a second ink source for supplying a second colored ink having a second color. The second color is different than the first color. A first reservoir supply valve is operably connected to the first opening, and is configured to open and close the first opening to enable and disable a flow of the first colored ink into the mixing reservoir. A second reservoir supply valve is operably connected to the second opening, and is configured to open and close the second opening to enable and disable a flow of the second colored ink into the mixing reservoir. An ink mixer is positioned within the mixing reservoir and configured to mix the first colored ink and the second colored ink within the mixing reservoir to form a custom colored ink. A printhead is operably connected to a printhead supply opening of the mixing reservoir to receive the custom colored ink from the mixing reservoir. A printhead supply valve is operably connected between the printhead supply opening and the printhead. The printhead supply valve is configured to open and close the third opening to enable and disable a flow of the custom colored ink from the mixing reservoir to the printhead. A housing is configured to support the mixing reservoir and the printhead, the housing being configured for connection and removal from an imaging device.

In another embodiment, an inkjet imaging device is provided. The inkjet imaging device comprises an image receiving surface; a plurality of ink supply sources, each ink supply source being configured to supply a different color of ink; a custom color printhead module configured to emit a custom colored ink onto the image receiving surface, the custom colored ink having a color corresponding to a combination of at least two component colors, the at least two component colors being colors supplied by the plurality of ink supply sources. The custom color printhead module includes a mixing reservoir including a plurality of openings, each opening being configured for removable connection to one of the ink supply sources and including a valve configured to open and close to enable and disable a flow of ink from the respective supply source into the mixing reservoir, the mixing reservoir including a mixer for mixing inks received in the mixing reservoir to form the custom colored ink; and a printhead operably connected to the mixing reservoir to receive the custom colored ink from the mixing reservoir, the printhead being positioned to emit the custom colored ink onto the image receiving surface; and a controller configured to open and close the valves of the openings in the mixing reservoir associated with the at least two component colors of ink to dispense measured quantities of the at least two component colors of ink into the mixing reservoir; the custom color printhead module including a housing configured to support the mixing reservoir and the printhead.

In another embodiment, another custom color printhead module is provided that comprises a printhead configured to emit a custom colored ink onto an ink receiving surface. The custom colored ink has a color corresponding to a combination of at least two component colors. The module includes a mixing reservoir having a plurality of ink receiving openings, each ink receiving opening being configured to receive a different color of ink from an ink supply source. Each ink receiving opening in the plurality of ink receiving openings includes a valve configured to open and close to enable and disable a flow of ink from the respective ink supply source into the mixing reservoir. The mixing reservoir includes a mixer configured to mix ink received in the mixing reservoir to form the custom colored ink, and a printhead supply valve configured to open and close to enable and disable a flow of the custom colored ink to the printhead. A housing is configured to support the mixing reservoir and the printhead. The housing is configured for connection and removal from an imaging device while supporting the mixing reservoir and the printhead and without interrupting print operations of the imaging device. A controller is configured to open and close the valves of the openings in the mixing reservoir associated with the at least two component colors of ink of the custom colored ink in order to dispense measured quantities of the at least two component colors of ink into the mixing reservoir to form the custom colored ink.

BRIEF DESCRIPTION OF THE DRAWINGS

The foregoing aspects and other features of the radiant heating unit and web heating systems incorporating radiant heating units are explained in the following description, taken in connection with the accompanying drawings, wherein.

DETAILED DESCRIPTION

Figure 1:
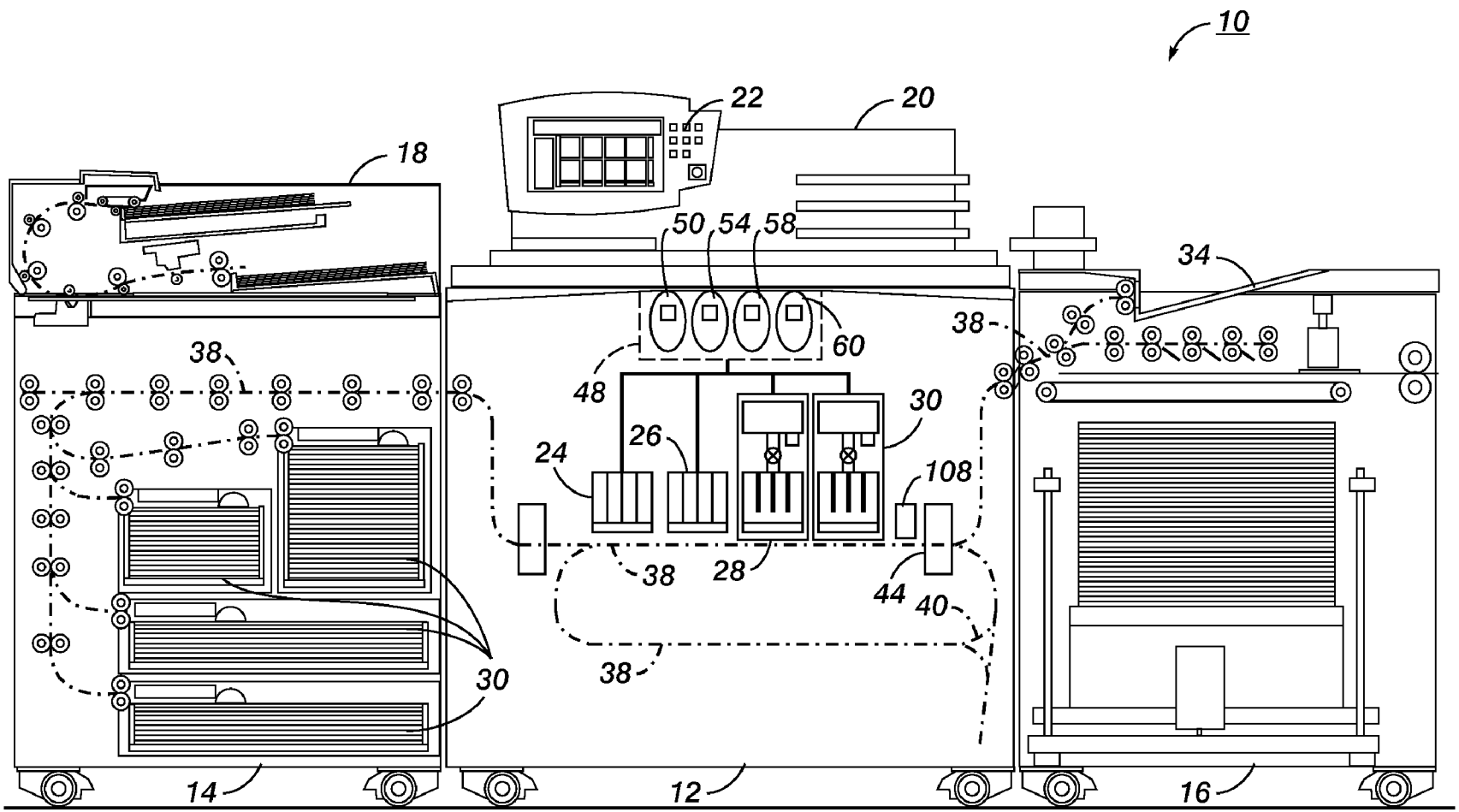
FIG. 1 is a block diagram of a phase change imaging device that includes at least one custom color printhead module.

For a general understanding of the present embodiments, reference is made to the drawings. In the drawings, like reference numerals have been used throughout to designate like elements.

As used herein, the term "imaging device" generally refers to a device for applying an image to print media. "Print media" can be a physical sheet of paper, plastic, or other suitable physical print media substrate for images, whether precut or web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

With reference to FIG. 1, there is shown an embodiment of a phase change ink jet imaging device 10 that is capable of mixing custom color inks in the imaging device from a preloaded set of color ink sticks. In particular, the exemplary imaging device includes a print station 12 that includes multiple printhead modules 24, 26, 28, 30 for emitting ink onto print media to form images. In the embodiment of FIG. 1, the printhead modules 24, 26, 28, 30 comprise phase change ink printhead modules for emitting melted phase change ink onto the print media. As explained in more detail below, at least one of the printhead modules is a custom color printhead module 28, 30 that is configured to mix a predetermined ratio of different colored melted phase change ink in the printer to create a custom colored ink for printing.

The print station 12 is interposed between a feeder module 14 and a finishing module 16. The print station 12 is fed with print media from the feeder module 14 as is known in the art. For example, the feeder module 14 may include a plurality of print media sources such as trays 30. Each feeder tray 30, may include print media having different attributes such as roughness, coats, weights and the like. The print media may be substantially any type of media upon which the printhead modules may print, such as: high quality bond paper, lower quality "copy" paper, overhead transparency sheets, high gloss paper, etc. In alternative embodiments, the printer 10 may be a web fed printer in which the feeder module 14 is configured to feed a continuous web of material, such as a roll of paper, a supply roller, or the like, (not shown) to the print station which may then be taken up on a take up roller or post-processed by, for example, cutting or trimming as needed at the finishing module.

The finisher module 16 receives the print media from the print station 12. The term "finisher" or "finishing module" as broadly used herein in connection with the exemplary embodiment or embodiments disclosed herein, is any post-printing accessory device such as an inverter, reverter, sorter, mailbox, inserter, interposer, folder, stapler, collator, stitcher, binder, over-printer, envelope stuffer, postage machine, output tray, or the like. In the illustrated embodiment, the finisher module 16 includes an output tray 34 to which received print media sheets can be delivered. The finisher module 16 may be configured to provide various finishes to the print media sheets of a print job or jobs, or even a portion of a print job.

Finishes can include, for example, patterns of collation, binding or stapling available by the finisher module. Additional, advanced finishes can include, for example, other binding techniques, shrink wrapping, various folding formats, etc. The finisher module 16 can also be provided with multiple output trays (not shown) and the ability to deliver specified print media sheets to a selected output tray or trays.

A print media transporting system links the feeder module 14, print station 12, and finisher module 16. The print media transporting system includes a network of media pathways 38 for guiding the movement of the print media through the imaging device 10. The print media transporting system may comprise drive members, such as pairs of rollers, spherical nips, airjets, or the like. The transport system may further include associated motors for the drive members, belts, guide rods, frames, etc. (not shown), which, in combination with the drive members, serve to convey the print media along selected pathways at selected speeds. In the illustrated embodiment, the print media from the source 14 is delivered to the print station 12 by a pathway which is common to the trays 30. The print media is printed on by the printhead modules of the print station 12 that are arranged along the media pathway 38. The pathway 38 also conveys the printed media to the finisher 38.

The media transporting system may include inverters, reverters, interposers, bypass pathways, etc. as known in the art to direct the print media to the appropriate positions for processing. For example, as shown in FIG. 1, the imaging device may include an output side inverter 40 connected with the output pathway. In addition, the media pathway is arrange generally horizontally at least through the print area of the print station, although, as can be seen, at least portions of the pathway may travel in other directions such as vertical.

The print station 12 may also include a fixing assembly 44 for fixing the emitted ink drops, or image, to the web. The fixing assembly 44 may be any suitable type of device or apparatus, as is known in the art, which is capable of fixing the image to the media. The type of fixing assembly is dependent upon the type(s) of ink that are used in the imaging device. For example, in solid ink embodiments, the fixing assembly may comprise a pair fixing rollers (not shown) that are positioned in relation to each other to form a nip through which the media is fed. The ink drops on the media are pressed into the media and spread out on the media by the pressure formed by the nip. For aqueous inks, the fixing assembly may include a dryer or heater for applying heat to the printed ink in order to fix the ink to the media. In embodiments in which UV curable inks are used, the fixing assembly may include a UV lamp for applying ultraviolet radiation to the printed ink.

Operation and control of the various subsystems, components and functions of the device 10 are performed with the aid of a controller 20. The controller 20 may be implemented as hardware, software, firmware or any combination thereof. In one embodiment, the controller 20 comprises a self-contained, microcomputer having a central processor unit (not shown) and electronic storage (not shown). The electronic storage may store data necessary for the controller such as, for example, the image data, component control protocols, etc. The electronic storage may be a non-volatile memory such as a read only memory (ROM) or a programmable non-volatile memory such as an EEPROM or flash memory. Of course, the electronic storage may be incorporated into the ink jet printer, or may be externally located.

During operations, the controller 20 receives image data from an image data source. The image data source may be any one of a number of different sources, such as a scanner, a digital copier, a facsimile device that is suitable for generating electronic image data, or a device suitable for storing and/or transmitting electronic image data, such as a client or server of a network, or the Internet. To print multicolor images, the controller 20 may use a color conversion process to convert the color specifications in the image data to the color space that is capable of being printed by the imaging device 10. In order to print multicolor images that include shades of color other than the colors of ink as supplied from the ink supply source, the controller may be configured to implement a halftone imaging process as is known in the art to produce the desired color based on the input color value. For example, the controller may be configured to convert a color space of the image to be rendered into halftone densities of a plurality of colorants available within the imaging device.

With continued reference to FIG. 1, the print station 12 includes multiple printhead modules for emitting ink onto the print media in accordance with the image data. In the embodiment of FIG. 1, print station is configured to implement a solid ink printing process to print images onto the print media. Accordingly, the printhead modules of the print station are configured as phase change ink, or solid ink, printhead modules. Each printhead module is appropriately supported adjacent the media pathway for emitting drops of ink directly onto the print media as the media moves through the print zone 18. In alternative embodiments, the printhead assembly may be configured to emit drops onto an intermediate transfer member (not shown), such as a drum or belt, for subsequent transfer to the media.

Ink is supplied to the printhead modules from the solid ink supply 48. Since the phase change ink imaging device 10 is a multicolor device, the ink supply 48 includes a plurality of solid ink sources 50, 54, 58, 60 which are each configured to supply a different color of ink to the printhead modules 24, 26, 28, 30. In one embodiment, each solid ink source 50, 54, 58, 60 of the solid ink supply comprises a dedicated channel for loading, feeding, and melting solid ink sticks of a particular color. In particular, the respective ink channels 50, 54, 58, 60 guide the appropriate colored solid ink sticks to a melting and control assembly or apparatus (not shown) for melting or phase changing the solid form of the phase change ink into a liquid form, and then supplying the liquid phase change ink to the printhead modules.

The solid ink sticks utilized in the imaging device may be standard colors (e.g., cyan, magenta, yellow, or black). For example, in the embodiment of FIG. 1, the solid ink supply 48 includes four sources representing the four CMYK colors (cyan, yellow, magenta, black) of solid ink. The system, however, may be adapted for a higher or lower number of different colored solid inks. For example, the imaging device may be configured with an expanded color gamut that includes solid inks of other colors in addition to the CMYK colors. In this embodiment, the solid ink supply includes solid ink sources (not shown) for supplying light cyan, light magenta, orange and green although any color may be used. In addition, although not depicted in FIG. 1, the imaging device may include solid ink sources for supplying premixed custom color ink which may be substantially any color. Any suitable number of solid ink sources and/or combinations of different colors of ink (e.g., standard CMYK, expanded color gamut, or premixed colors) may be utilized in the imaging device 10. The total number of different colors and combination of colors of solid ink made available in the system 10 may be dependent upon the overall number and range of colors desired to be printed.

Each printhead module 24, 26, 38, 30 is configured to receive at least one of the colors of ink from the solid ink supply and to emit the ink onto the media. Accordingly, each printhead module 24, 26, 38, 30 includes at least one printhead having a plurality of ink jet nozzles for ejecting the ink received from the solid ink supply. In one embodiment, each printhead 24, 26, 38, 30 is configured to eject ink by displacing ink in an ink pressure chamber thereby ejecting ink droplets. As is known in the art, a drive mechanism, such as a piezoelectric transducer bonded to a thin diaphragm, may be used to displace the ink in the pressure chamber. The controller 20 is configured to generate driving signals for driving the ink jets of the printhead modules to expel ink from the ink jets in the printheads to form an image on the print media in accordance with the image data.

In the embodiment of FIG. 1, there is depicted a CMYK printhead module 24, an expanded gamut printhead module 26, and at least one custom color printhead module 28, 30 (two of which are depicted in FIG. 1). The CMYK printhead module, as is known in the art, includes a printhead for each of the CMYK colors, i.e., a printhead for emitting cyan ink, a printhead for emitting magenta ink, a printhead for emitting yellow ink and a printhead for emitting black ink. Similarly, the expanded gamut printhead module includes a printhead for each of the colors in the expanded color gamut, i.e., a printhead for emitting light cyan ink, a printhead for emitting light magenta ink, a printhead for emitting orange ink and a printhead for emitting green ink. Although, the CMYK printhead module and expanded gamut printhead module have been described as having a separate printhead for each color of ink, other arrangements are contemplated. For example, each printhead module may comprise a single printhead having a dedicated array of ink jet nozzles for ejecting each color of ink received from the solid ink supply, i.e., an array of nozzles for ejecting cyan ink, an array of nozzles for ejecting magenta ink, etc. Alternatively, there may be a separate printhead module for each color of ink utilized in the imaging device. For example, there may be a cyan printhead module, a magenta printhead module, a yellow printhead module, etc.

The printheads utilized in the printhead modules may have any suitable configuration such as page-width array, partial page-width array, and carriage type printheads. For example, a printhead module may have at least one page-width array printhead for each color of ink associated with the printhead module. In another embodiment, a printhead module may have a plurality of partial-width array printheads for each color associated with the printhead with the plurality of partial-width array printheads being arranged end-to-end in a straight line or staggered formation for spanning the media pathway of the imaging device. In yet another embodiment, the printhead modules may be mounted on a carriage or similar support structure so that the printheads of the printhead module may be moved with respect to the media. As can be determined by one of ordinary skill in the art, a plurality of possible arrangements and configurations for the printheads of the printhead modules are possible and are contemplated within the scope of this disclosure.

Customers may desire to print images or portions of images with custom colors in order to, for example, provide instant identification and authenticity to a document. Accordingly, the imaging device of FIG. 1 is configured to allow the specification of one or more custom colors to be used by the print apparatus. The specification of custom colors to be used during printing may be made in any suitable manner such as through the user interface 22 of the imaging device. In one embodiment, the input may comprise a custom color identifier that is defined in a color specification system, such as the Pantone Color Matching System (CMS). The custom color identifier, however, may comprise any value, alphanumeric character, symbol, etc. that may be associated with a particular color by an imaging device control system.

Figure 2:
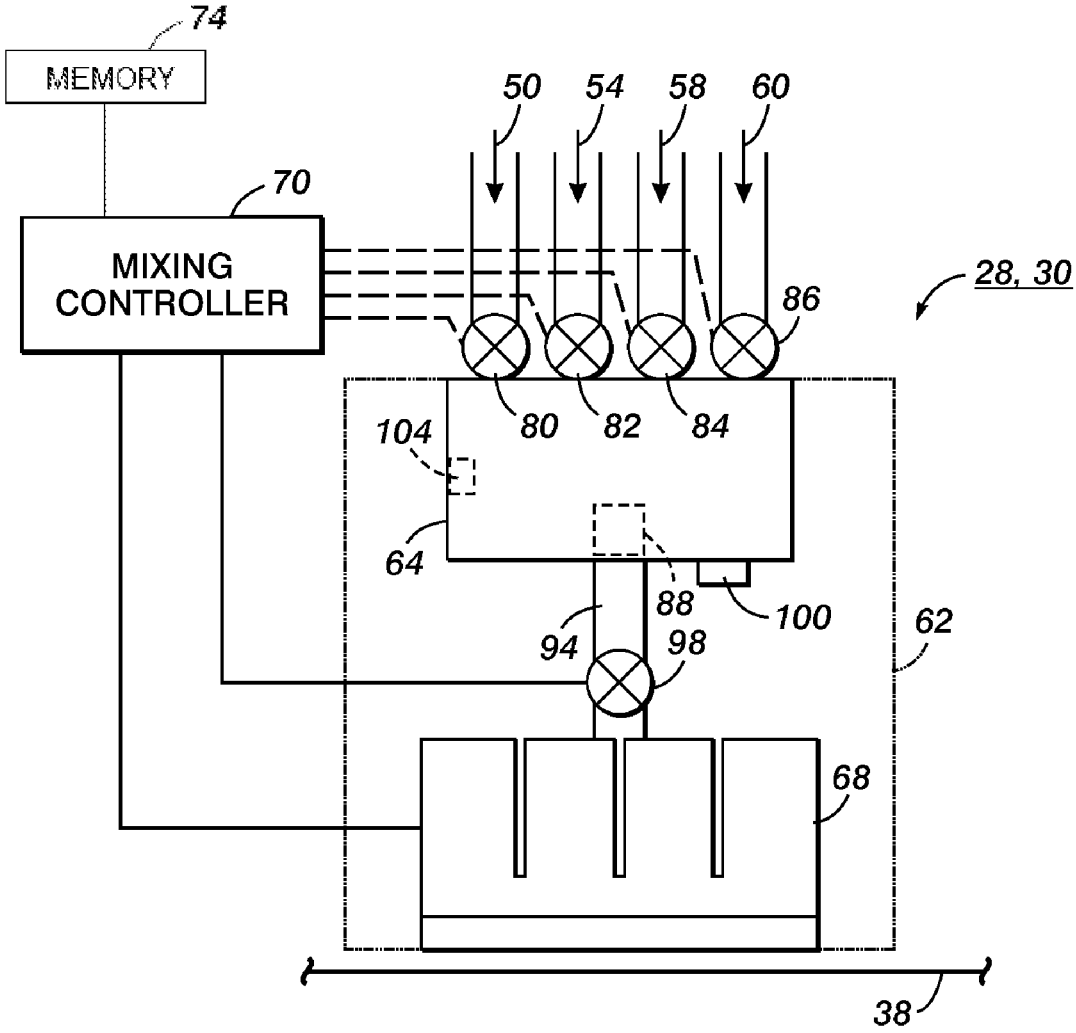
FIG. 2 is a block diagram of the custom color printhead module of FIG. 1.

In order to print using custom colors, the imaging device 10 as depicted in FIG. 1 has been provided with at least one custom color printhead module 28, 30 that is configured to mix a custom color ink in the module from the set of solid inks that are preloaded into the imaging device. The term "custom color," as used herein, may generally refer to any color that differs from the colors of ink utilized in the imaging device (e.g., cyan, magenta, yellow, black, etc.). Referring now to FIG. 2, a schematic diagram of an exemplary custom color printhead module 28 is shown arranged adjacent a media pathway 38. The custom color printhead module 28 includes a housing 62, a mixing reservoir 64, at least one custom color printhead 68, and a mixing controller 70.

The mixing reservoir 64 is configured to receive melted phase change ink of at least two different colors from the solid ink supply and to mix the different colors of ink to form a custom color ink. Accordingly, the mixing reservoir includes a plurality of ink supply inlets that are configured to receive molten phase change ink from a plurality of the solid ink sources. In one embodiment, the mixing reservoir may be configured to receive ink from each of the ink sources of the solid ink supply. To simplify the discussion, the mixing reservoir as depicted in FIG. 2 is configured to receive melted phase change ink from the cyan 50, magenta 54, yellow 58, and black 60 solid ink sources. The custom color printhead module 28, however, may be intended to print a specific custom color and, therefore, may be configured to receive only the colors of ink that are required to produce the desired custom color.

The custom color printhead module 28 includes one or more ink dispensers for dispensing measured quantities of phase change ink into the mixing reservoir via the ink supply inlets. Accordingly, the custom color printhead module of FIG. 2 includes dispensers 80, 82, 84, 86 for controlling the flow of ink into the mixing reservoir from each of the cyan, magenta, yellow, and black solid ink sources 50, 54, 58, 60. The flow rates of the inks through the dispensers may be determined in any suitable manner as is known in the art so that the quantities of the inks that are dispensed into the mixing reservoir may be accurately controlled. In one embodiment, the dispensers 80, 82, 84, 86 may comprise one-way dispensing valves that open and close to control the flow of ink from an associated ink supply source to the mixing reservoir 64. The dispensers, however, may comprise any suitable device or structure that is capable of controlling and/or metering the ink from the respective ink supply sources. For example, the dispensers may include pumps, pressure sensors, temperature sensors, etc. for facilitating the accurate dispensing of the inks into the reservoir.

The mixing reservoir 64 may comprise any suitable container or structure capable of holding molten phase change ink received via the supply valves. The mixing reservoir may be any size. In the embodiment of FIG. 2, the mixing reservoir is configured to hold approximately 10 ml of ink. The relatively small size of the reservoir allows for faster mixing of the component colors of ink and minimizes the amount of custom color ink that has to be maintained in the reservoir ready for printing so that the ink is not wasted. The mixing reservoir 64 may include one or more mixing elements 88, which may be, for example, mechanical, magnetic, pneumatic, hydraulic, or ultrasonic stirrers, powered by electricity or other suitable source. The mixing elements 88 are configured to mix or blend the different quantities of different color ink in the mixing reservoir to form a custom color ink. The mixing reservoir 64 may also include a heating element (not shown) for controlling the temperature of the ink contained in the mixing reservoir. For instance, the mixing reservoir 64 may be heated to maintain the phase change ink contained in the reservoir in molten form. In addition, the heating element may be configured to heat the reservoir to substantially any suitable temperature for mixing and/or maintaining the ink in condition for printing. The controller 70 may be configured to monitor the temperature of the ink inside the reservoir and to cycle the heating element in order to maintain the desired temperature of the ink.

The mixing reservoir 64 is connected to the custom color printhead through at least one custom color supply conduit 94. The custom color ink in the mixing reservoir 64 may be supplied to the printhead 68 as needed for printing onto the print media. The module may include a supply valve 98 for enabling and disabling the flow of ink into the printhead from the mixing reservoir 64. The printheads 68 of the custom color printhead modules may be configured for removal or replacement from the custom color modules. For example, the printheads used in the custom color modules may be similar or even identical to the printheads used in the standard printhead modules. Thus, the custom color printhead modules may comprise a "carrier" that accepts a standard ink jet printhead. To configure the custom color printheads for removal from the custom color module, the supply valve 98 may be configured as a disconnect valve to allow the printhead to be easily removed from the custom color module. The disconnect valve is advantageously configured to prevent the flow of ink from the mixing reservoir through the custom color supply conduit when the printhead is removed from the module.

The custom color printhead module 28 may include a mixing controller 70. The mixing controller 70 is configured to control the supply valves 80, 82, 84, 86 to dispense measured quantities of each component color of ink into the mixing reservoir to form the target custom color. In addition, the mixing controller 70 controls the mixing elements 88 in the reservoir 64 to mix the component colors to form the target custom color. The component colors and the amounts of each component color required to form a target custom color may be determined with reference to the color identifier for the custom color. For example, the color identifier such as a Pantone number may have associated mixing data that specifies the component colors, the amounts of each component color required to form a target custom color, durations of the opening of the respective supply valves to supply the amounts, duration of the mixing phase, etc. All of the possible color identifiers and associated color recipes may be stored in memory 74 in a data structure such as a database or table. The mixing controller 70 may use the color identifier as a lookup key for accessing the data structure to retrieve the mixing data associated with the particular identifier. Once the mixing data is determined for a particular custom color, the mixing controller 70 controls the supply valves in order to dispense predetermined amounts of the component colors into the mixing reservoir according to the color recipe and controls the mixing element to mix the component colors to form the target custom color. Mixing data may be determined for each desired custom color of ink in any suitable manner. For example, the mixing data may be determined empirically and subsequently stored in the memory 74 of the imaging device for access by the controller.

A color sensor 100 may be utilized to provide feedback to the mixing controller 70 as to the actual color of the ink in the mixing reservoir. The color of the ink in the mixing reservoir 64 may be measured optically using, for example, either light reflected from the ink surface, or light transmitted through a controlled thickness of the liquid ink. Any suitable type of color sensor may be used such as a spectrophotometer, a colorimeter, a photometer, or the like. In the embodiment of FIG. 2, a color sensor 100 is positioned to detect the color of the ink the reservoir prior to printing. The mixing controller 70 may be configured to compare the measured color value to a target color value or target color range to verify whether the ink in the reservoir corresponds to the target custom color. As is known in the art, target color values or ranges may be predetermined and stored in the memory of the controller or programmed into the controller. If the actual or measured color value is not equal to the target color value or within the target color value range, the mixing controller 70 may be configured to determine the fractional amounts of component inks from the ink supply sources to be mixed in reservoir 64 to compensate for deviations from the target color value and to adjust the supply valves accordingly.

The mixing reservoir 64 may also include a level sensor 104 for sensing a level of the molten phase change ink within the mixing reservoir 64. During printing, the controller 70 is configured to monitor the ink level in the mixing reservoir 64 to ensure that the mixing reservoir is constantly replenished by the component colors in the ratios that are defined by the color recipe corresponding to the desired custom color. For example, as printing activities continue, the controller 70 monitors the level of the mixed ink in the mixing reservoir 64 via the level sensor 104 and controls the appropriate supply valve members 80, 82, 84, 86 to replenish the mixing reservoir 64 with the appropriate amounts of ink from the required ink supply sources as the ink is printed.

The mixing controller 70 is configured to maintain a consistent color in the mixing reservoir as well as maintain a substantially constant level of ink within the reservoir. Over time, the output of the imaging device may drift (or deviate from predetermined optimum standards) due to various factors. These factors include environmental conditions (temperature, relative humidity, etc.), use patterns, the type of media (e.g., different paper types and paper batches, transparencies, etc.) used, variations in media, general wear, etc. Accordingly, the mixing controller may be configured to monitor the printed color to detect deviations from a target color that may be due to the factors listed above such as type of media used. The actual color of the ink in the mixing reservoir may be measured after the ink has been printed onto a print media by positioning a color sensor adjacent to the media pathway downstream from the custom color printhead module. For example, referring to FIG. 1, the imaging device 10 may include a color sensor 108 positioned adjacent the media pathway downstream from the custom color printhead modules 28, 30 to measure the printed color on the media. The measured color value of the printed color may be compared to the target custom color value to detect deviations in the printed color from the target color that may result from using different types of print media, for example. For instance, based on the differences between the target color and the actual printed color for the different types of print media, the mixing controller 70 may tune the mixing data for the particular type of media and save the adjustments so that the adjusted color recipe may be utilized the next time the particular type of media is used in the imaging device.

In addition to monitoring and adjusting custom colors to maintain color consistency, the imaging device may be configured to allow a customer or printer user to modify or adjust an existing custom color to suit particular needs and save the modified custom color for reuse later. In one embodiment, the user interface 22 of the imaging device is configured to allow a user to identify or select a particular custom color that has previously been stored in the memory by inputting a custom color identifier such as a Pantone number, by selecting a custom color identifier from a list using a cursor, etc. The user interface may also be configured to receive as an input custom color modification data for the selected custom color. Custom color modification data may include instructions for increasing or decreasing the relative amounts of one or more of the component colors used to generate the selected custom color. The modification data may also include instructions for adding one or more additional component colors to the custom color. The controller is configured to receive the custom color modification data corresponding to a selected custom color identifier and to modify the mixing data associated with the selected custom color identifier in accordance with the custom color modification data. The modified mixing data may be stored in association with the selected custom color identifier or the modified mixing data may be stored in association with a new custom color identifier that may be specified by a customer via the user interface.

Multiple custom color printhead modules may be used in the imaging device. Each custom color module may be configured to print a different custom color of ink. As depicted in FIG. 1, the imaging device includes two custom color printhead modules 28, 30 although any suitable number may be used. The custom color printhead modules may be removable for storage outside the imaging device, and/or to enable swapping of custom color modules. By configuring the custom color modules as removable or replaceable, the range of custom colors that are capable of being printed by the imaging device may be increased without increasing the size or complexity of the imaging device.

To facilitate removal and/or replacement of the custom color modules, the housing 62 of the custom color printhead modules may be configured for releasable connection to the print station of the imaging device in any suitable manner. For example, the print station may include module positions or slots that are configured to releasably secure a custom color module in an operable position adjacent the media pathway in the print station. The housings for separate custom color printhead modules are similarly sized so that the modules may be swapped or replaced as needed. The supply valves that control the flow of ink into the mixing reservoir of a custom color module may be configured as disconnect valves so that the supply lines may be removed from the modules prior to removal. The disconnect valves are advantageously configured to prevent the custom color ink from leaking from the mixing reservoir when the custom color module is removed from the imaging device.

Accordingly, the imaging device 10 may be reconfigured at any time to suit the particular print jobs to be handled. For example, a user may have a particular print job which requires a custom color not provided by any of the custom color modules currently in the system. The user may switch one of the existing custom color modules for a custom color module having the desired custom color capabilities. This may be achieved without stopping printing operations by scheduling the changeover for a period of time when the remaining printhead module(s) can handle the requirements of the jobs being printed at the time.

When a custom color printhead module is removed from the imaging device, the module may be placed in a cleaning unit (not shown) which may be configured to purge the ink from the module. A printer user may put a new, clean custom color printhead module into the imaging device and program it for a particular custom color while the previous module is being cleaned and purged. The cleaning unit configuration may have any suitable configuration and may contain solvents for pumping through the printhead. Once cleaned, a custom color printhead module may be used to print the same or a different custom color of ink.

The custom color printhead modules have been described with reference to a phase change ink jet printer; however, the custom color printhead modules may also be used in other types of ink jet printers where one desires to be able to mix and print with custom colors in the printer. Accordingly, those skilled in the art will recognize that numerous modifications can be made to the specific implementations described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A custom color printhead module for use in an inkjet printing device, the custom color printhead module comprising:

a first ink dispenser operatively connected to a first ink source that supplies ink having a first color to a first printhead, the first dispenser having a supply valve that is configured to open and close to enable and disable, respectively, a flow of ink having the first color from the first ink source through the first ink dispenser;

a second ink dispenser operatively connected to a second ink source that supplies ink having a second color to a second printhead, the second color being different than the first color, the second dispenser having a supply valve that is configured to open and close to enable and disable, respectively, a flow of ink having the second color from the second ink source through the second ink dispenser;

a mixing reservoir having a first opening and a second opening, the first opening being configured for removable connection to the supply valve of the first ink dispenser to enable the mixing reservoir to receive the ink having the first color from the first dispenser, the second opening being configured for removable connection to the supply valve of the second ink dispenser to enable the mixing reservoir to receive ink having the second color from the second dispenser;

an ink mixer positioned within the mixing reservoir, the ink mixer being configured to mix the ink having the first color and the ink having the second color within the mixing reservoir to form an ink having a third color that is different than the ink having the first color and the ink having the second color;

a third dispenser operatively connected to an outlet of the mixing reservoir and a third printhead, the third dispenser having a supply valve configured to open and close to enable and disable, respectively, a flow of the ink having the third color to the third printhead;

a housing configured to support the mixing reservoir and the third printhead and enable the first and the second opening of the mixing reservoir to be operatively connected to the supply valve of the first dispenser and the supply valve of the second dispenser, respectively; and a controller operatively connected to the first dispenser, second dispenser, the third dispenser, and the ink mixer, the controller being configured to open and close the supply valve of the first dispenser and the supply valve of the second dispenser to enable ink having the first color and ink having the second color to enter the mixing reservoir through the first and the second openings, respectively, to operate the ink mixer, and to open and close the supply valve of the third dispenser to enable and disable, respectively, a flow of ink having the third color to the third printhead while the first printhead continues to receive ink having the first color from the first ink source and the second printhead continues to receive ink having the second color from the second ink source.

2. The custom color printhead module of claim 1, further comprising:

a memory in which a plurality of custom color ink identifiers are stored, the memory including custom color mixing data stored in association with each custom color ink identifier, wherein the controller is operatively connected to the memory, the controller being configured to open and close the supply valve of the first dispenser and the supply valve of the second dispenser to dispense quantities of the ink having the first color and the ink having the second color into the mixing reservoir in accordance with the custom color mixing data stored in association with one of the custom color ink identifiers stored in the memory.

3. The custom color printhead module of claim 2, the controller being configured to receive a custom color identifier, the custom color identifier corresponding to a color of ink having the third color, the controller being configured to access the memory to retrieve the custom color mixing data corresponding to the ink having the third color using the custom color identifier.

4. The custom color printhead module of claim 2, the custom color ink identifiers comprising Pantone numbers.

5. The custom color printhead module of claim 1, further comprising:

a sensor configured to detect an optical characteristic of the ink having the third color, the optical characteristic corresponding to a detected color of the ink having the third color, the controller being configured to compare the detected optical characteristic to a target optical characteristic for the ink having the third color and to open and close the supply valve of the first dispenser and the supply valve of the second-dispenser to enable and disable flow of at least one of the inks having the first color and the second color into the mixing reservoir to compensate for deviations of the detected optical characteristic from the target optical characteristic, and to open the supply valve of the third dispenser to enable flow of the ink having the third color to the third printhead in response to the detected optical characteristic corresponding to the target optical character.

6. The custom color printhead module of claim 2, the controller being configured to receive custom color modification data, the custom color modification data corresponding to at least one custom color identifier stored in the memory, the controller being configured to modify the mixing data associated with the at least one custom color identifier in accordance with the custom color modification data and to store the modified mixing data in the memory in association with the at least one custom color identifier.

7. The custom color printhead module of claim 1 further comprising:

a level sensor positioned within the mixing reservoir and configured to detect a level of ink in the mixing reservoir, the controller being operatively connected to the level sensor and configured to monitor the level of the ink in the mixing reservoir detected by the level sensor and to operate at least one of the supply valves in the first and second dispensers with reference to the detected ink level.

* * * * *